US008973680B2

(12) United States Patent
MacKenzie

(10) Patent No.: US 8,973,680 B2
(45) Date of Patent: Mar. 10, 2015

(54) LOCKABLE REAMER

(75) Inventor: Alan MacKenzie, Catterline (GB)

(73) Assignee: Nov Downhole Eurasia Limited, Stonehouse (GB)

( * ) Notice: Subject to any disclaimer, the term of this patent is extended or adjusted under 35 U.S.C. 154(b) by 603 days.

(21) Appl. No.: 13/198,594

(22) Filed: Aug. 4, 2011

(65) Prior Publication Data

US 2012/0031673 A1 Feb. 9, 2012

(30) Foreign Application Priority Data

Aug. 5, 2010 (GB) ..... 1013165.4

(51) Int. Cl.
*E21B 10/32* (2006.01)
*E21B 7/28* (2006.01)
*E21B 23/00* (2006.01)

(52) U.S. Cl.
CPC ..... *E21B 10/322* (2013.01); *E21B 23/00* (2013.01)
USPC ..... 175/280; 175/279

(58) Field of Classification Search
USPC ..... 175/263, 279, 290, 286, 280
See application file for complete search history.

(56) References Cited

U.S. PATENT DOCUMENTS

| | | | | |
|---|---|---|---|---|
| 904,344 | A | 11/1908 | Maples | |
| 1,485,642 | A | 4/1922 | Stone | |
| 1,810,201 | A | 12/1928 | Campbell | |
| 3,433,313 | A | 3/1969 | Brown | |
| 4,889,197 | A | 12/1989 | Boe | |
| 5,368,114 | A | 11/1994 | Tandberg et al. | |
| 6,732,817 | B2 | 5/2004 | Dewey et al. | |
| 7,252,163 | B2 | 8/2007 | Ollerenshaw et al. | |
| 7,493,971 | B2 | 2/2009 | Nevlud et al. | |
| 7,658,241 | B2 | 2/2010 | Lassoie et al. | |
| 7,681,666 | B2 | 3/2010 | Radford et al. | |
| 7,703,553 | B2 | 4/2010 | Eddison et al. | |
| 7,757,787 | B2 | 7/2010 | Mackay et al. | |
| 7,823,663 | B2 | 11/2010 | Eddison | |
| 2005/0205305 | A1 * | 9/2005 | Stout et al. | 175/292 |
| 2008/0070038 | A1 | 3/2008 | Vincent et al. | |
| 2010/0089583 | A1 * | 4/2010 | Xu et al. | 166/298 |

FOREIGN PATENT DOCUMENTS

| | | | |
|---|---|---|---|
| GB | 2147033 | | 5/1985 |
| GB | 2446294 | A | 8/2008 |
| NO | 330479 | B1 | 4/2011 |
| WO | 2004/048744 | | 6/2004 |
| WO | 2004/097163 | A1 | 11/2004 |
| WO | 2005/103435 | A1 | 11/2005 |

(Continued)

OTHER PUBLICATIONS

IADC/SPE Drilling Conference, "Wellbore Enlargement for a Deepwater Casing Program: Case Study and Developments, Abstract", Mar. 2-4, 2004, Dallas, TX, pp. 1-11.

(Continued)

*Primary Examiner* — Brad Harcourt
(74) *Attorney, Agent, or Firm* — JL Salazar Law Firm

(57) ABSTRACT

A downhole tool comprises a body, an extendable cutting member operable to cooperate with a hydraulically actuated cam member, and a cam member lock. The lock is configurable to be activated downhole to restrict movement of the cam member relative to the body and prevent extension of the cutting member.

32 Claims, 4 Drawing Sheets

(56) References Cited

FOREIGN PATENT DOCUMENTS

| | | |
|---|---|---|
| WO | 2007/017651 A1 | 2/2007 |
| WO | 2008/070052 | 6/2008 |

OTHER PUBLICATIONS

Search Report dated Oct. 26, 2010 for United Kingdom patent application No. GB1013165.4 (3 pages).

* cited by examiner

LOCKABLE REAMER

CROSS-REFERENCE TO RELATED APPLICATIONS

This application claims the benefit of GB Patent Application No. 1013165.4, filed on Aug. 5,2010, the entire contents of which are hereby incorporated by reference.

FIELD OF THE INVENTION

This invention relates to a lockable downhole tool and in particular, but not exclusively, to a lockable reamer or under-reamer. The invention also relates to a method of using such a tool.

BACKGROUND OF THE INVENTION

In the oil and gas exploration and production industry, bores are drilled from surface to access sub-surface hydrocarbon bearing formations. The drilled bores are lined with tubing, known as casing or liner, and cement is injected into the annulus between the casing and surrounding bore wall. Typically, the bore is drilled in sections, and after drilling a section that section is lined with casing. Following cementing of the casing, the next section of bore is drilled. However, as the drill bit utilised to drill the next section must pass through the existing casing, the drill bit will of necessity be of smaller diameter than the drill bit used to drill the previous section. It is often considered desirable to enlarge the bore diameter below a section of casing beyond the drill bit diameter, and this is normally achieved by means of an under-reamer mounted above the drill bit. The under-reamer and drill bit may be arranged to cut rock simultaneously, or the under-reamer may be selectively activated to ream selected sections of an existing bore.

During reaming operations, rock cuttings and other debris are created and recovered from the well bore by circulating fluid down the drill pipe and returning the fluid up the annulus created between the drill pipe and the well bore casing. After all reaming operations have been completed, the drill pipe conveyed under-reaming tool is recovered from the well bore by pulling the drill pipe, in sections or stands, from the well bore. During recovery of the under-reaming tool it may be necessary to circulate fluid down through the drill pipe and subsequently up the annulus in order to clear obstructions caused by debris remaining in the annulus. Under these circumstances, a hydraulically activated under-reamer may experience sufficient differential pressure, between the internal tubing and the annulus, to activate the internal mechanism causing the cutters to move radially outwards and contact the casing lining the well bore. Simultaneous lateral or rotational movement of the under-reamer in this condition will cause damage to the casing or damage to the under-reaming tool. As it is common practice to rotate the drill pipe during debris clean-out operations so as to agitate the debris, an inappropriately extended reamer tool could cause significant and extensive damage.

SUMMARY OF THE INVENTION

According to an aspect of the present invention there is provided a downhole tool comprising: a body; at least one extendable cutting member operable to cooperate with a hydraulically actuated cam member, and a cam member lock configurable to be activated downhole to restrict movement of the cam member relative to the body and prevent extension of the cutting member.

According to another aspect of the invention there is provided a downhole operation comprising:

running a downhole tool into a bore;

extending a cutting member from a body of the tool;

retracting the cutting member;

activating a lock to prevent subsequent extension of the cutting member; and retrieving the tool from the bore.

The invention facilitates retrieval of the tool, typically in the form of a reaming tool, more particularly an under reamer, with the cutting member locked in the retracted configuration. Embodiments of the invention allow an operator to circulate fluid through the locked tool, for example to facilitate hole cleaning, safe in the knowledge that the cutting member will be retained in the retracted position.

The cam member lock may take any appropriate form and in one embodiment may be a mechanical lock. The lock may be configurable to create a mechanical interference or lock between a part of the cam member and a part of the body. The lock may provide the interference directly, or may interact with another element, which may be an element of the body or the cam member to create or provide the interference. For example, the lock may support a dog or collet finger in a locking configuration. In other embodiments the lock may take other forms, for example a hydraulic or magnetic lock.

The cam member lock may include a portion adapted for location between the body and the cam member and configured to restrict movement therebetween. Said portion may include one or more collet fingers. The lock may be mounted in the body above the cam member and may be adapted to cooperate with an upper end portion of the cam member. This may facilitate retrofitting of the lock to an existing tool, where the upper end of one or both of the cam member and body may be modified to accommodate the lock.

The lock may be actuated by any appropriate means. In one embodiment, the lock may be configured to be activated by using a device dropped or pumped from surface, for example a ball or dart. The device may be configured to cooperate with a portion of the lock to permit creation of a differential pressure across the lock and permit hydraulic actuation of the lock, which may involve pressure-induced longitudinal translation of a portion of the lock. The lock may be initially retained in or biased towards an inactive configuration. The lock may define a fluid passage and the device may substantially occlude the passage. In one embodiment the lock may define a seat and the device may be configured to land on the seat to restrict or prevent flow through the lock. In moving the lock to the locking position a fluid flow path may be reestablished through the lock.

The cam member may be biased towards a configuration in which the cutters are retracted. The cam member and lock may be configured such that the cam member may move to cutter-retracted position while the lock is activated. Thus, the lock may be activated while the cutting member is extended and the cam member is permitted to return to the retracted configuration and is then latched or locked in the retracted configuration. This allows the lock to be activated without requiring fluid circulation to be stopped or reduced for an extended period.

BRIEF DESCRIPTION OF THE DRAWINGS

These and other aspects of the present will now be described, by way of example, with reference to the accompanying drawings, in which.

DETAILED DESCRIPTION OF THE DRAWINGS

Figure 1:
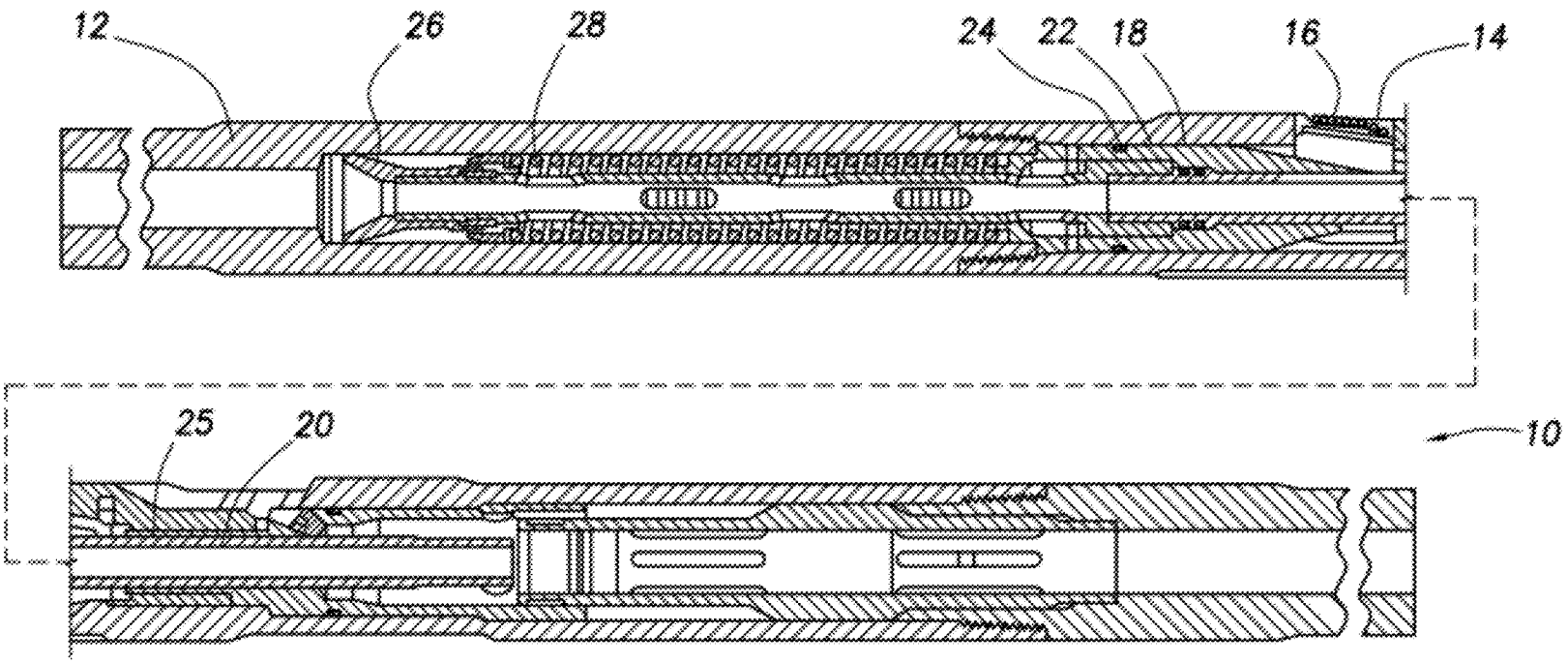
FIG. 1 is a sectional view of an existing hydraulic under-reamer.

Reference is first made to FIG. 1 of the drawings, which is a sectional view of a conventional hydraulic under-reamer, such as supplied by the applicant. The reamer 10 is adapted to form part of a drill string and will be positioned towards the lower end of the string, above the drill bit. The reamer 10 comprises an elongate tubular body 12 formed from a number of connected parts. Windows 14 in the body 12 accommodate radially movable cutters 16 which co-operate with corresponding cam members 18, whereby axial movement of the cam members 18 causes the respective cutters 16 to radially extend and retract. The cam members 18 form part of a central assembly 20 including an annular piston 22, the piston seals 24, 25 being arranged such that an elevated internal pressure will tend to cause the assembly 20, including the cam member 18, to move axially downwards (from left to right in FIG. 1) and extend the cutters 16. An upper part of the assembly 20 features a funnel 26 which directs fluid flowing through the body 12 and through the center of the assembly 20. A coil spring 28 is accommodated in an annulus 30 between the upper end of the assembly 20 and the body 12 and acts to urge the assembly 20 upwards relative to the body 12 and thus to move the cutters 16 towards the retracted configuration.

As described above, during recovery of the under-reamer 10 following completion of a reaming operation, fluid may be circulated down through the drill string and subsequently up the annulus. The drill string and the under-reamer 10 may be rotated as this fluid circulation takes place. If the differential pressure between the interior of the under-reamer and the annulus is sufficient, the differential pressure acting across the piston 22 may be sufficient to move the cam member downwardly and extend the cutters 16, causing damage to the well bore casing.

Figure 2:
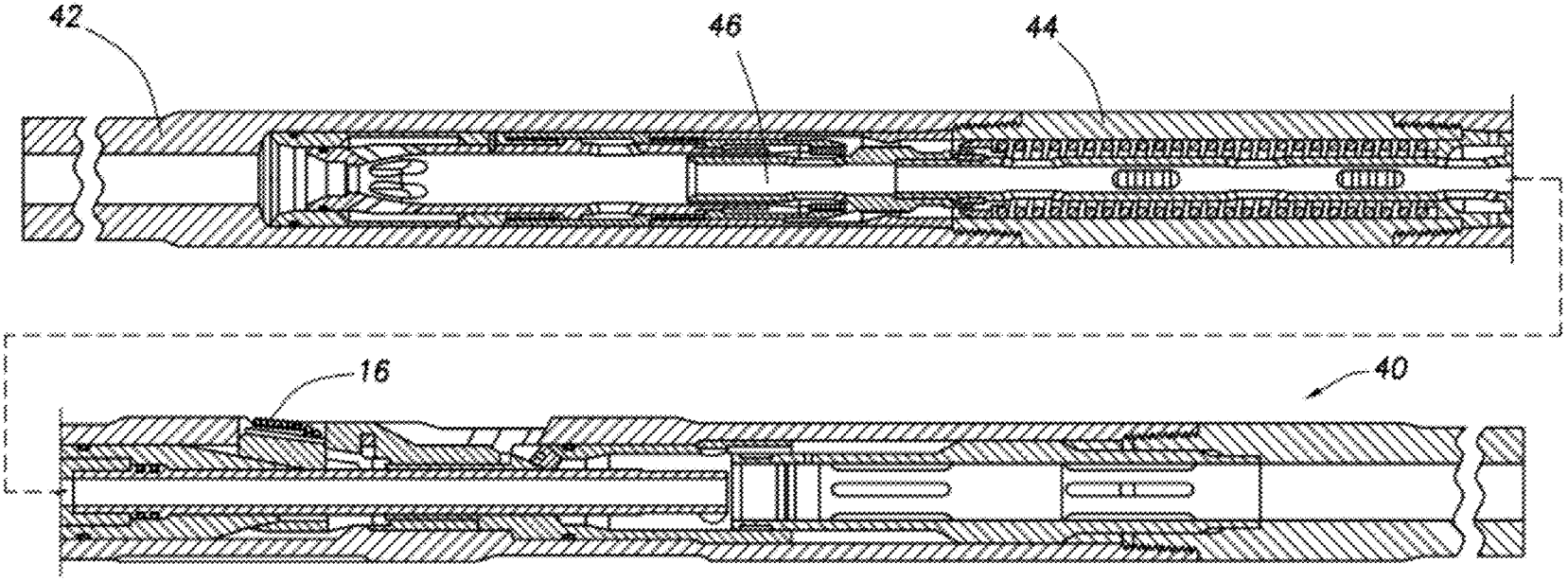
FIG. 2 is a sectional view of a hydraulic under-reamer in accordance with an embodiment of the present invention.
Figure 3:
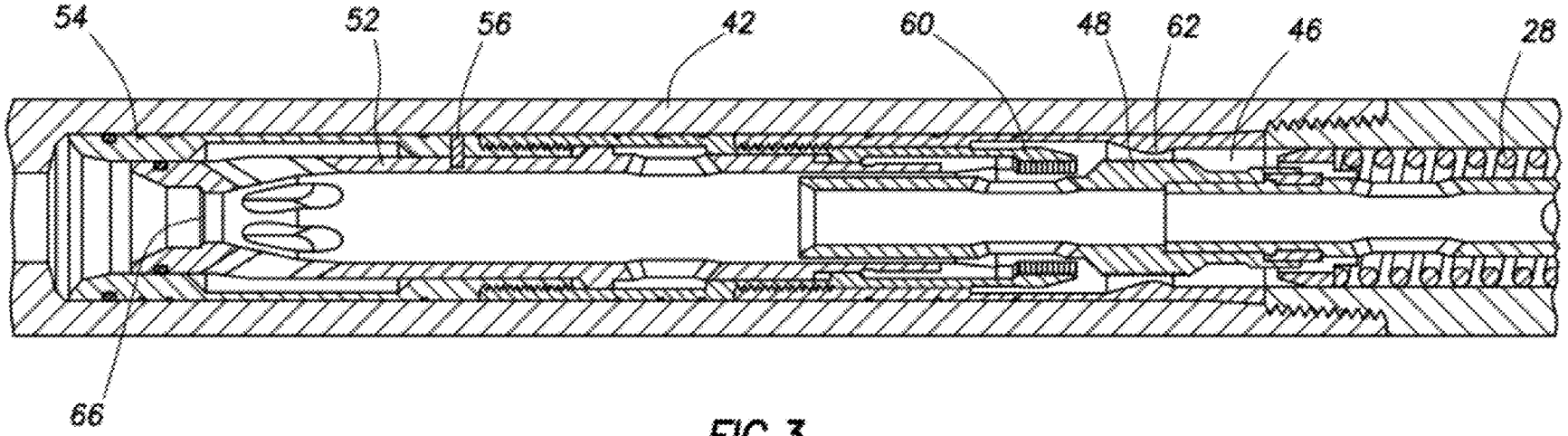
FIG. 3 is an enlarged sectional view showing the lock closed mechanism of the under-reamer of FIG. 2.
Figure 4:
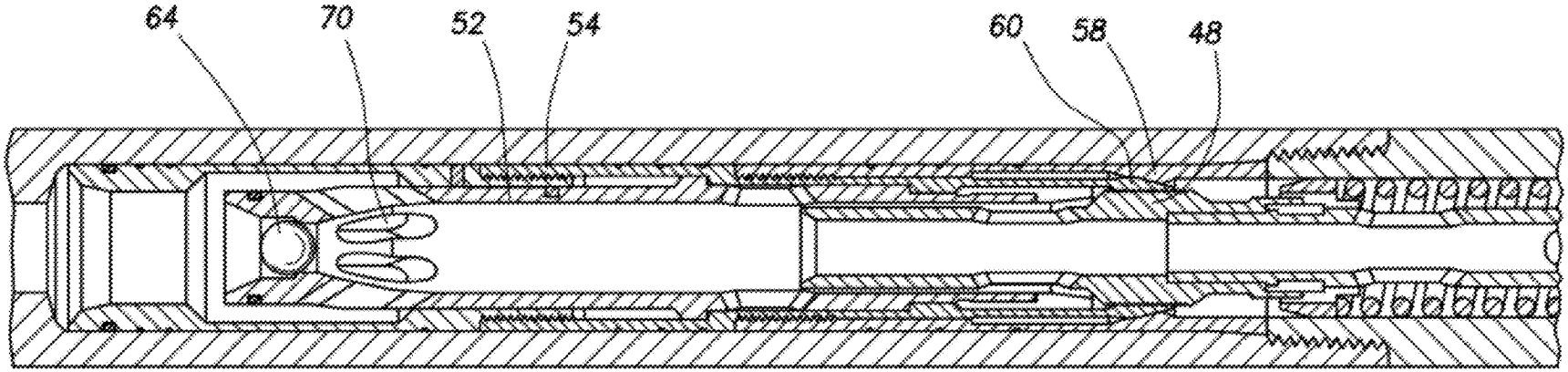
FIG. 4 corresponds to FIG. 3, but showing the lock closed mechanism in the activated configuration.

Reference is now made to FIGS. 2, 3 and 4 of the drawings, which illustrate an under-reamer 40 in accordance with an embodiment of the present invention. As will be described, the under-reamer 40 is configured to allow the reamer to be locked in the retracted and closed configuration such that fluid may be circulated through the under-reamer without any risk that the cutters will be extended.

The illustrated reamer 40 corresponds to a conventional reamer 10 which has been retrofitted with a lock arrangement in accordance with an embodiment of the present invention. Thus, the reamers 40, 10 share a number of common features. However, the upper or return sub 32 of the reamer 10 has been replaced with an alternative top sub 42 and pin sub 44 in the reamer 40. Also, the funnel 26 has been replaced by a modified funnel 46 featuring an external shoulder 48 with a toothed surface.

The top sub 42 receives the modified funnel 46 and accommodates a cam member lock in the form of an activation piston 52, shown in FIG. 3 in an initial, inactive configuration. In this configuration the upper end of the piston 52 is in sealing engagement with a housing 54 which lines the top sub 42. The piston 52 is initially fixed to the housing 54 by means of a shear pin 56.

The lower end of the activation piston 52 is located within a lower housing 58 and includes a gripping collett 60 which is initially located above the funnel shoulder 48 and an opposing shoulder 62 formed on the lower housing 58.

While the under-reamer 40 is in use, the activation piston 52 remains in the inactive configuration as illustrated in FIG. 3, and has no bearing on the operation of the under-reamer 40. However, once all under-reaming activities have been completed and it is desired to lock closed the tool, a steel ball 64 is dropped through the drill string and lands on a seat 66 at the upper end of the activation piston 52. The application of hydraulic pressure to the inside of the drill string will thus now generate a differential pressure across the ball and piston 64, 52 and the associated down force will shear the pin 56. The piston 52 may then move downwards inside the upper and lower housings 54, 58 to the position as illustrated in FIG. 4 of the drawings. The downwards motion of the activation piston 52 relative to the reamer body pushes the gripping collett 60 between the funnel and housing shoulders 48, 62, such that the fingers of the collett 60 flex radially outwards to engage with the matching profile on the outer surface of the funnel 46. The downward relative movement of the activation piston 52 also establishes a flow path around the ball 64 via an enlarged internal portion of the upper lockout housing 54 and flow ports 70 formed in the wall of the piston 52 so that fluid may still be circulated through the under-reamer 44 after the cutters have been locked closed.

Once the gripping collett 60 has engaged with the funnel shoulder surface, subsequent application of differential pressure across the under-reamer piston 22 will still urge the funnel 46 to move downwards. However, this force generates a radially inward acting reaction from the lower housing shoulder 62, increasing the engagement between the gripping collett 60 and the funnel shoulder 48. The funnel 46 and the other associated elements of the assembly 20, including the cam member 18, are thus locked against axial movement relative to the tool body. Accordingly, as the tool is recovered from the well bore, unrestricted fluid circulation through the drill string with simultaneous rotation and up and down movement of the drill string may be commenced without the risk of the cutters 16 extending and damaging the casing or the reamer 40.

It should also be noted that the cam lock activation piston 52 may be moved downwards while the reamer cutters 16 are in the extended configuration, and the funnel shoulder 48 is not aligned with the housing shoulder 62. However, once the differential pressure falls, the spring 28 lifts the assembly and positions the funnel shoulder 48 beneath the flexible gripping collett fingers 60. The ratchet-like formations on the funnel shoulder surface and the gripping collett face will prevent subsequent movement of the funnel 46 in the downward direction.

It will be apparent to those of skill in the art that the above described embodiment is merely exemplary of the present invention, and that various modifications and improvements may be made thereto, without departing from the scope of the invention.

What is claimed is:

1. A reamer for reaming a bore of a sub-surface formation, the reamer deployable into the bore via a downhole tool, comprising:

a body;

a longitudinal member within the body defining an axial throughbore through the body;

at least one extendable cutting member operable to cooperate with an actuatable cam member, the cam member having a first configuration in which the least one extendable cutting member is extended and a second configuration in which the least one extendable cutting member is retracted; and a cam member lock activatable downhole, the cam member lock permitting movement of the cam member from the first configuration to the second configuration and preventing movement of the cam member from the second configuration to the first configuration;

wherein the axial throughbore extends through the body to allow fluid to pass through the reamer in the first and second configurations without extending the cutters when the cam member lock is activated;

wherein the cam member lock is configurable to restrict movement of the cam member relative to the body.

2. The reamer of claim 1, wherein the cam member lock is configurable to create a mechanical interference between a part of the cam member and a part of the body.

3. The reamer of claim 1, wherein the cam member lock comprises a portion locatable between a portion of the body and a portion of the cam member to restrict movement therebetween.

4. The reamer of claim 3, wherein the cam member lock portion comprises at least one collet finger.

5. The reamer of claim 1, wherein the cam member lock is mounted in the body uphole from the cam member and is cooperatable with an upper end portion of the cam member.

6. The reamer of claim 1, wherein the cam member lock is activatable by using a device dropped from surface.

7. The reamer of claim 6, wherein the device is a ball.

8. The reamer of claim 6, wherein the device is cooperatable with a portion of the cam member lock to permit creation of a differential pressure across the cam member lock and permit hydraulic actuation of the cam member lock.

9. The reamer of claim 8, wherein actuation of the cam member lock comprises pressure-induced longitudinal translation of the portion of the cam member lock.

10. The reamer of claim 6, wherein the cam member lock is initially biased towards an inactive configuration.

11. The reamer of claim 6, wherein the cam member lock defines a fluid passage and the device substantially occludes the fluid passage.

12. The reamer of claim 6, wherein the cam member lock defines a seat and the device lands on the seat to restrict flow through the cam member lock.

13. The reamer of claim 12, wherein the downhole tool is configurable such that moving the cam member lock to a locking position reestablishes a fluid flow path through the cam member lock.

14. The reamer of claim 1, further comprising at least one collet finger, wherein the longitudinal member comprises an activation piston slidably positionable in the body and the at least one collet finger is disposed about the activation piston, the actuator piston being slidable in the body to move the cam member to extend and retract the at least one extendable cutting member, the at least one collet finger engageable with a raised shoulder along an outer surface of the actuator piston to lock the cam member in the second configuration.

15. The reamer of claim 14, wherein the actuator piston comprises a funnel, the raised shoulder positionable about the funnel.

16. The reamer of claim 14, wherein the cam member is urged to the second configuration by a spring disposed between the actuator piston and the body.

17. The reamer of claim 14, wherein the raised shoulder has a toothed surface engageable by the at least one collet finger.

18. The reamer of claim 1, wherein the cam member lock comprises a cam lock activation piston, the cam lock activation piston slidably movable in the body, and upon activation from an unlocked position to a locking position the cam lock activation piston is locked relative to the body.

19. The reamer of claim 18, further comprising a shear pin disposable in the cam lock activation piston to initially restrict movement thereof.

20. The reamer of claim 18, wherein the cam lock activation piston has a tubular body with a seat therein to receive a ball.

21. A method of reaming a bore of a sub-surface formation, comprising:

running a downhole tool into the bore, the downhole tool having a reamer comprising a body, a longitudinal member within the body defining an axial throughbore through the body, at least one extendable cutting member, a cam member and a cam member lock;

extending and retracting the at least one extendable cutting member from a body of the downhole tool by activating the cam member;

activating a cam member lock downhole to permit retraction of the at least one extendable cutting member from a first configuration in which the at least one extendable cutting member is extended and to prevent extension of the at least one extendable cutting member from a second configuration in which the at least one extendable cutting member is retracted; and allowing fluid to pass through the reamer in the first and second configurations via the axial throughbore without extending the cutters when the cam member lock is activated.

22. The method of claim 21, further comprising locking the at least one extendable cutting member in a retracted configuration and retrieving the downhole tool from the bore.

23. The method of claim 22, further comprising circulating fluid through the downhole tool with the cam member lock activated.

24. The method of claim 21, further comprising creating a mechanical interference between a part of the cam member and a part of the body.

25. The method of claim 21, further comprising locating a portion of the cam member lock between the body and the cam member.

26. The method of claim 21, further comprising activating the cam member lock by dropping a device from surface to cooperate with a portion of the cam member lock, create a differential pressure across the cam member lock and actuate the cam member lock.

27. The method of claim 21, further comprising longitudinally translating of a portion of the cam member lock.

28. The method of claim 21, further comprising initially retaining the cam member lock in an inactive configuration.

29. The method of claim 21, further comprising substantially occluding a fluid passage through the cam member lock to activate the cam member lock and then reestablishing the fluid passage through the cam member lock.

30. The method of claim 21, further comprising activating the cam member lock while the at least one extendable cutting member is extended; permitting the at least one extendable cutting member to return to a retracted configuration; and then latching the at least one extendable cutting member in the refracted configuration.

31. A reamer for reaming a bore of a sub-surface formation, the reamer deployable into the bore via a downhole tool, comprising:

a body;

a longitudinal member within the body defining an axial throughbore through the body;

at least one extendable cutting member operable to cooperate with an actuatable cam member, the cam member having a first configuration in which the at least one extendable cutting member is extended and a second configuration in which the least one extendable cutting member is retracted; and a cam member lock activatable downhole, the cam member lock permitting movement of the cam member from the first configuration to the second configuration and preventing movement of the cam member from the second configuration to the first configuration;

wherein the axial throughbore extends through the body to allow fluid to pass through the reamer in the first and second configurations without extending the cutters when the cam member lock is activated;

wherein the cam member lock is mounted in the body uphole from the cam member and is cooperatable with an upper end portion of the cam member.

32. A reamer for reaming a bore of a sub-surface formation, the reamer deployable into the bore via a downhole tool, comprising:

a body;

a longitudinal member within the body defining an axial throughbore through the body;

at least one extendable cutting member operable to cooperate with an actuatable cam member, the cam member having a first configuration in which the at least one extendable cutting member is extended and a second configuration in which the least one extendable cutting member is retracted; and a cam member lock activatable downhole, the cam member lock permitting movement of the cam member from the first configuration to the second configuration and preventing movement of the cam member from the second configuration to the first configuration;

wherein the axial throughbore extends through the body to allow fluid to pass through the reamer in the first and second configurations without extending the cutters when the cam member lock is activated;

wherein the cam member lock is activatable by using a device dropped from surface.

* * * * *